US010480919B1

(12) United States Patent
Gremoletti

(10) Patent No.: US 10,480,919 B1
(45) Date of Patent: Nov. 19, 2019

(54) ADDITION OF A TELEMETRY FUNCTION IN AN ARTILLERY RADAR DEVICE FUZE

(71) Applicant: LEONARDO S.p.A., Rome (IT)

(72) Inventor: Alessandro Gremoletti, Rome (IT)

(73) Assignee: LEONARDO S.P.A., Rome (IT)

( * ) Notice: Subject to any disclaimer, the term of this patent is extended or adjusted under 35 U.S.C. 154(b) by 0 days.

(21) Appl. No.: 15/916,726

(22) Filed: Mar. 9, 2018

(30) Foreign Application Priority Data

Mar. 10, 2017 (EP) ..... 17160435

(51) Int. Cl.
*F42C 13/04* (2006.01)
*F42C 13/00* (2006.01)

(52) U.S. Cl.
CPC ..... *F42C 13/04* (2013.01); *F42C 13/00* (2013.01)

(58) Field of Classification Search
None
See application file for complete search history.

(56) References Cited

U.S. PATENT DOCUMENTS 4,245,560 A * 1/1981 Rambauske ..... F42C 13/023 102/213
4,884,506 A * 12/1989 Guerreri ..... F42C 11/06 102/200
5,525,975 A 6/1996 Walker et al.
5,574,462 A * 11/1996 Schmucker ..... F42C 13/04 342/68
6,237,271 B1 * 5/2001 Kaminski ..... F41A 17/063 42/70.01

FOREIGN PATENT DOCUMENTS

DE 33 42 934 6/1985
KR 2017 0000835 1/2017

* cited by examiner

*Primary Examiner* — Stephen Johnson
(74) *Attorney, Agent, or Firm* — Leason Ellis LLP

(57) ABSTRACT

A fuze for an explosive weapon, comprising onboard sensors to monitor operation of the fuze and/or the explosive weapon, a radar sensor to transmit radar signals and receive reflected radar signals, and an electronic signal processor connected to the onboard sensors and to the radar sensor and programmed to implement a main operating function aimed at implementing a detonation logic, and a secondary operating function supplemental to the main one and comprising a telemetry function designed to determine, based on signals from the onboard sensors, and to transmit, via the radar sensor, telemetry data indicative of the operation of the fuze and/or the explosive weapon during flight thereof.

8 Claims, 4 Drawing Sheets

ADDITION OF A TELEMETRY FUNCTION IN AN ARTILLERY RADAR DEVICE FUZE

PRIORITY CLAIM

This application claims priority from European Patent Application No. 17160435.8 filed on Mar. 10, 2017, the disclosure of which is incorporated by reference.

TECHNICAL FIELD OF INVENTION

The present invention relates in general to artillery fuzes for explosive weapons, and in particular to artillery radar device fuzes, such as proximity or multifunction artillery fuzes. The present invention specifically relates to the addition of a telemetry function in radar device fuzes.

STATE OF THE ART

As is known, in the field of (air- or ground-) launched explosive weapons, a fuze is an internal trigger device operable to trigger the explosion of an explosive load in an explosive weapon, whether self-propelled or otherwise, and guided or otherwise, such as an artillery projectile, a bomb, a torpedo or a missile (explosives carrier), at the moment of impact of the explosive weapon on a target or at a predetermined point along the trajectory thereof.

Broadly speaking, fuzes can be grouped into the following categories: impact (or contact or percussion), delayed-impact, time, altimetry and proximity. Impact fuzes trigger the detonation of the internal load as a consequence of the impact of the explosive weapon on the target, time fuzes trigger the explosion of the internal load after a given time is elapsed from firing, altimetry fuzes are equipped with radar devices operable to detect the altitude of the explosive weapon with respect to the underlying ground or sea so as to trigger the detonation of the internal load at a certain altitude, while proximity fuzes are equipped with the same radar devices operable to detect the target during the trajectory of the explosive weapon so as to trigger the explosion of the internal load only in proximity of the target, without ever coming into contact.

Recently, particularly advanced multifunction fuzes have been introduced on the market, which are based on radar devices and are programmable, during a so-called fuze setting phase, to implement operating functions selectable from a set of available operating functions comprising an altimetry function, a proximity function, an impact function, a delayed-impact function, and a time function.

OBJECT AND SUMMARY OF THE INVENTION

The object of the present invention is to provide improved radar device fuzes.

According to the present invention, a radar device fuze is provided, as claimed in the appended claims.

DETAILED DESCRIPTION OF PREFERRED EMBODIMENTS OF THE INVENTION

The present invention will now be described in detail with reference to the accompanying drawings to enable a skilled person to embody it and use it. Various modifications to the described embodiments will be immediately obvious to experts in the field, and the generic principles described herein can be applied to other embodiments and applications without departing from the scope of the present invention, as defined in the appended claims. Therefore, the present invention should not be considered as limited to the described and illustrated embodiments, but is to be accorded the widest scope consistent with the characteristics described and claimed herein.

Broadly speaking, the present invention stems from the Applicant's observation that for a (large) part of the flight of an explosive weapon, the radar device is not used for implementing the function for which the fuze is designed, namely detecting the target during the flight of the explosive weapon towards the target to be hit for the purpose of triggering detonation of the internal load in proximity to the target.

Following this observation, the Applicant had the idea of using the radar device of the fuze as a transmitter rather than solely as a sensor, to transmit telemetry data indicative of the operation of the explosive weapon during the flight thereof towards the target to be hit during the periods of time when it is not used for implementing the function for which the fuze is designed.

Figure 1:
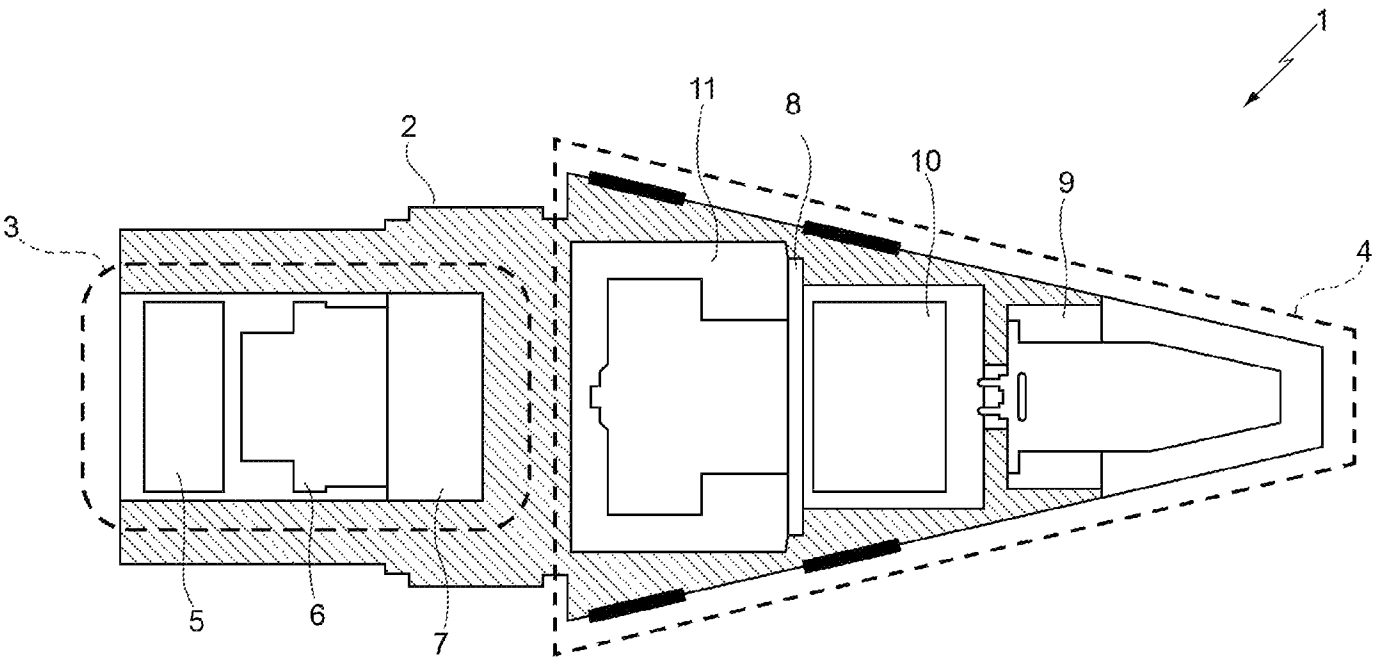
FIG. 1 shows a block diagram of a radar device fuze.

FIG. 1 shows a block diagram of a fuze for an explosive weapon.

The fuze 1 comprises a metal casing (carrier) 2 containing an armoured section 3 designed to survive impact, and an unarmoured section 4.

The armoured section 3 basically comprises a booster 5, a mechanical safety and arming device (SAD) 6, and trigger electronics 7 comprising an electro-explosive detonator (EED).

The unarmoured section 4 basically comprises:

onboard sensors 8 to monitor operation of the fuze 1 and/or of the explosive weapon and output data necessary to implement the operating logics of the explosive weapon and of the fuze 1;

a radar device 9 to transmit radar signals and receive reflected radar signals, an electronic signal processor 10 connected to the onboard sensors 8 and the radar device 9, and an electrical power source 11, in the form of batteries, to electrically supply electrical and electronic components of the fuze 1.

The onboard sensors 8 may be embedded in the electronic signal processor 10 and/or arranged outside the electronic signal processor 10 and expediently connected to the latter via a CAN bus (not shown).

The electronic signal processor 10 is programmed to store and execute a software designed to control operation of fuze 1, and which, when executed, cause the electronic signal processor 10 to implement the present invention, as described here below.

Figure 3:
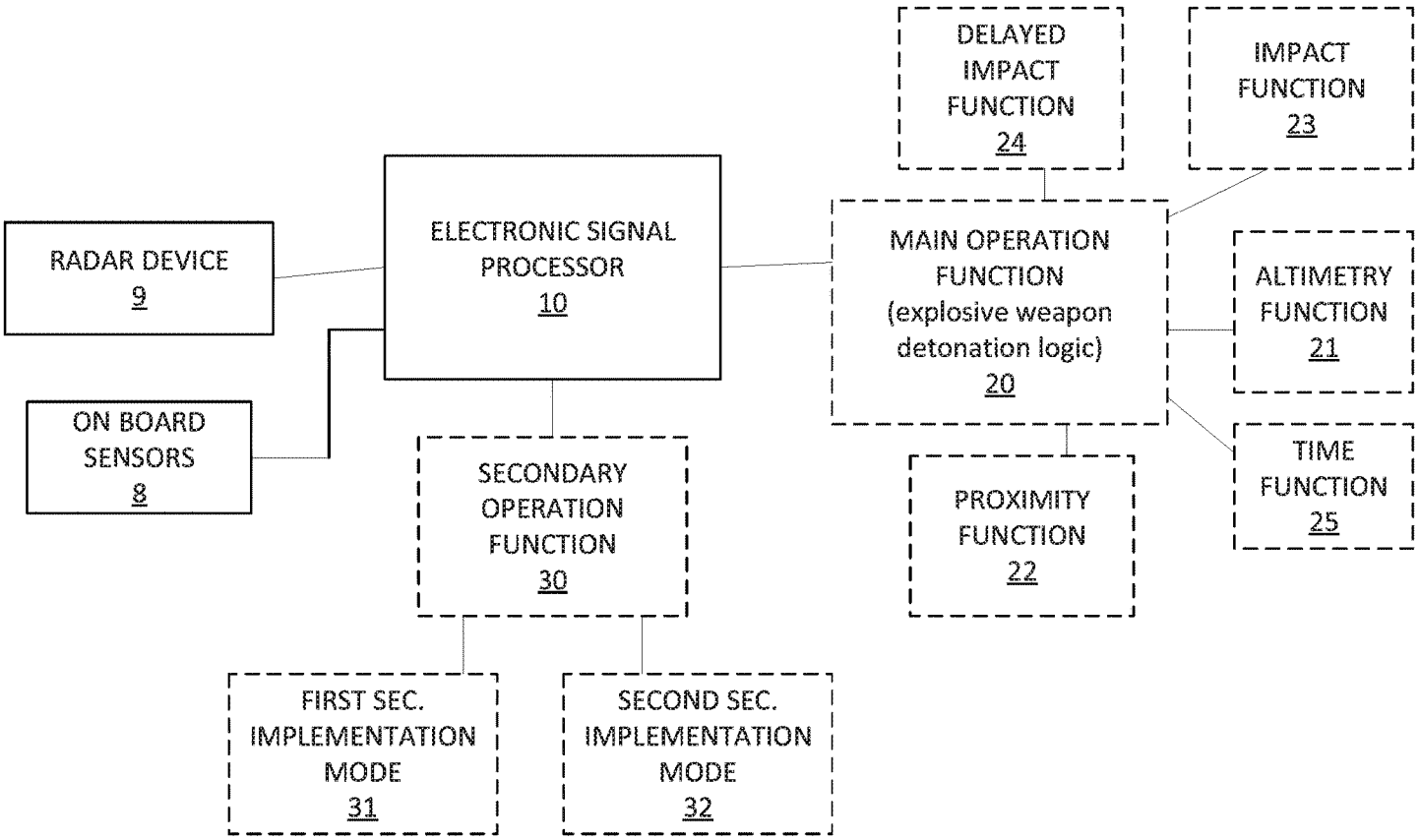
FIG. 3 shows a functional block diagram of a radar device fuze with secondary telemetry capability.

As shown in FIG. 3, the electronic signal processor 10 is programmed to implement a main operating function 20 which is programmable during a so-called fuze setting phase and designed to implement as associated explosive weapon detonation logic, dependent on the mission, based on received radar signals from the radar device 9.

To this end, the electronic signal processor 10 is programmed to allow the main operating function to be selected from available operating functions.

The available operating functions comprise an altimetry function 21, a proximity function 22, an impact function 23, a delayed-impact function 24, and a time function 25, each with an associated detonation logic.

It may be appreciated that only the proximity and altimetry functions operate based on the received radar signals from the radar device 9, while the other above-listed available operating functions operate based on signals from the onboard sensors 8.

To implement a main operating function 20 based on the radar device 9, the electronic signal processor 10 is programmed to control operation of the radar device 9, in a known manner which will not be described in detail, during the flight of the explosive weapon, to cause it to detect the target to be hit, and in particular to cause it to transmit continuous-wave radar signals, with or without frequency modulation (CW and FMCW), and to receive and processes the radar signals reflected by the target (proximity function) or by the underlying ground or sea (altimetry function) in order to determine the Doppler velocity and the mutual position between the explosive weapon and the target, or the altitude of the explosive weapon with respect to the underlying ground or sea.

The electronic signal processor 10 is further programmed to implement a secondary operating function 30 supplementary to the main one and comprising a telemetry function designed to determine, based on signals from the onboard sensors 8, and to transmit, via the radar device 9, telemetry data indicative of the operation of the explosive weapon to which the fuze 1 is associated during the flight of the explosive weapon towards the target.

The electronic signal processor 10 is further programmed to allow an implementation mode of the secondary operating function to be programmed during the fuze setting phase.

In particular, the electronic signal processor 10 is programmed to allow the implementation mode of the secondary operating function to be selected from available implementation modes.

The available implementation modes comprise a first implementation mode 31 in which the secondary operating function is implemented in periods of time when the main operating function is not implemented, and a second implementation mode 32 in which the secondary operating function is implemented simultaneously with the main operating function.

In the first implementation mode, the secondary operating function is conveniently implemented in a first part of the flight of the explosive weapon, then switching to the main operating mode, on which the detonation logic is based, only when necessary, i.e. in a final part of the flight of the explosive weapon.

In the second implementation mode, the secondary operating function is implemented either during the entire flight of the explosive weapon or, conveniently, only during part of the flight of the explosive weapon, appropriately sharing the radar device 9 and the electronic signal processor 10 to compute and transmit the telemetry data on flight diagnostics of the explosive weapon with which the fuze 1 is associated according to time-sharing techniques, usable, for example, in missions that do not require use of the radar device 9 (e.g. impact or time), and time-division techniques.

Figure 4:
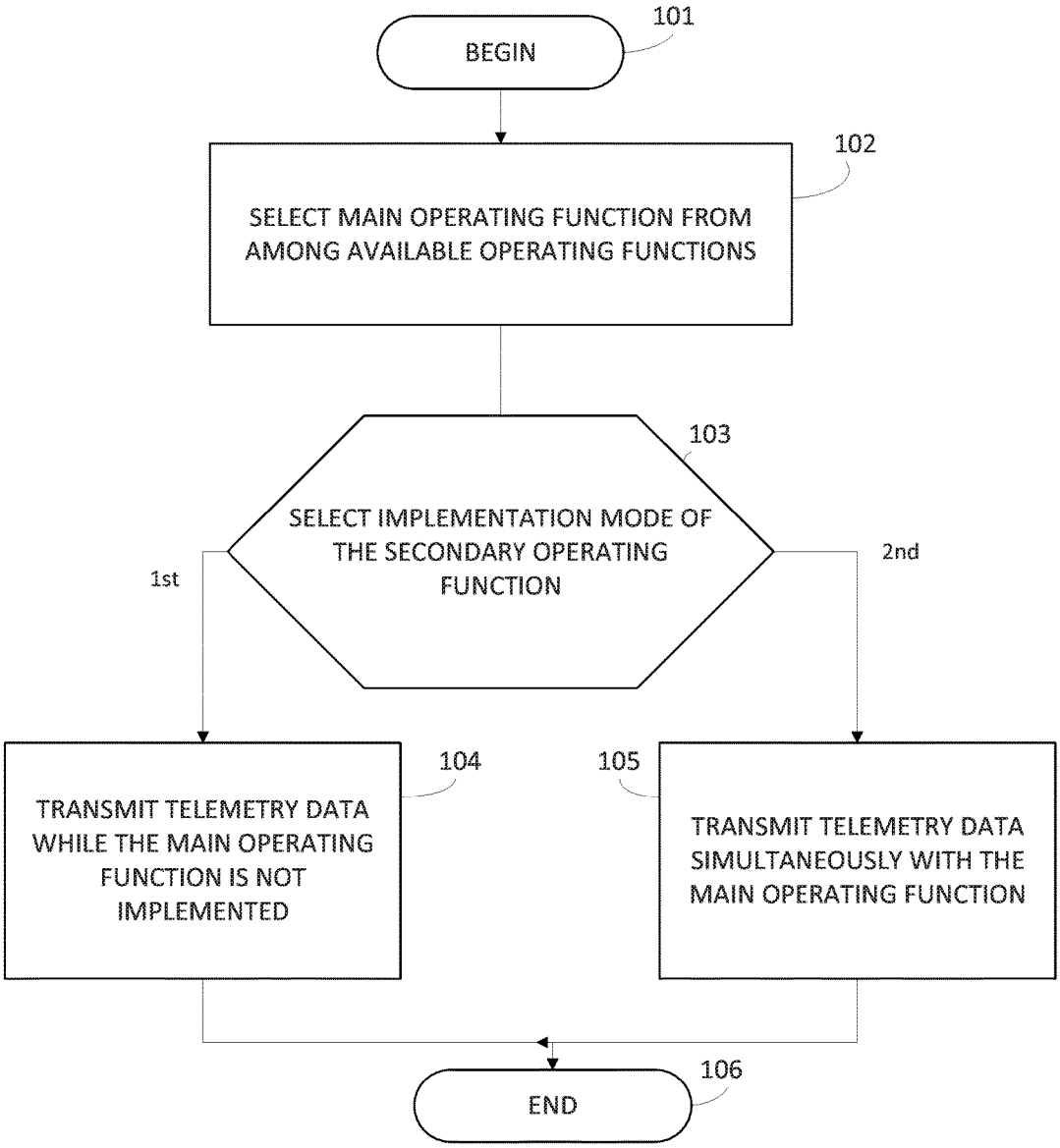
FIG. 4 shows a flow chart of a method of providing secondary telemetry functions according to an embodiment of the disclosure.

FIG. 4 shows a flow chart of a programming sequence that implements a method of providing secondary telemetry functions according to an embodiment of the disclosure. In step 101, the method begins. In step 102, a main operating function 20 is selected from among available operating function 21-25. In a following step 103, an implementation mode of the secondary function 30 is selected. If a first mode 31 of the secondary function is selected in step 103, in step 104 the radar device is controlled to transmit telemetry data while the main operating function is not implemented. If a second mode 32 of the secondary operating function is selected in step 103, in step 105 the radar device is controlled to transmit telemetry data simultaneously with the operation of the main operating function. The method ends in step 106.

The telemetry data is conveniently transmitted, via the radar device 9, in the form of a PCM (Pulse-Code Modulation) digital sequence, also used in conventional telemetry, modulated according to a digital modulation, preferably an FSK (Frequency Shift Keying) digital frequency modulation that associates the 1's and O's information of the PCM digital sequence with a variation of the frequency of the transmitted radar signal. The amplitude of the modulating digital sequence generated by the electronic signal processor 10 is appropriately defined as a function of the modulation constant of the radar device 9, which represents the ratio between the generated frequency span and the input voltage, and is such as to optimize the modulation factor and have a spectral content suitable for being detected by a telemetry receiver.

Figure 2:
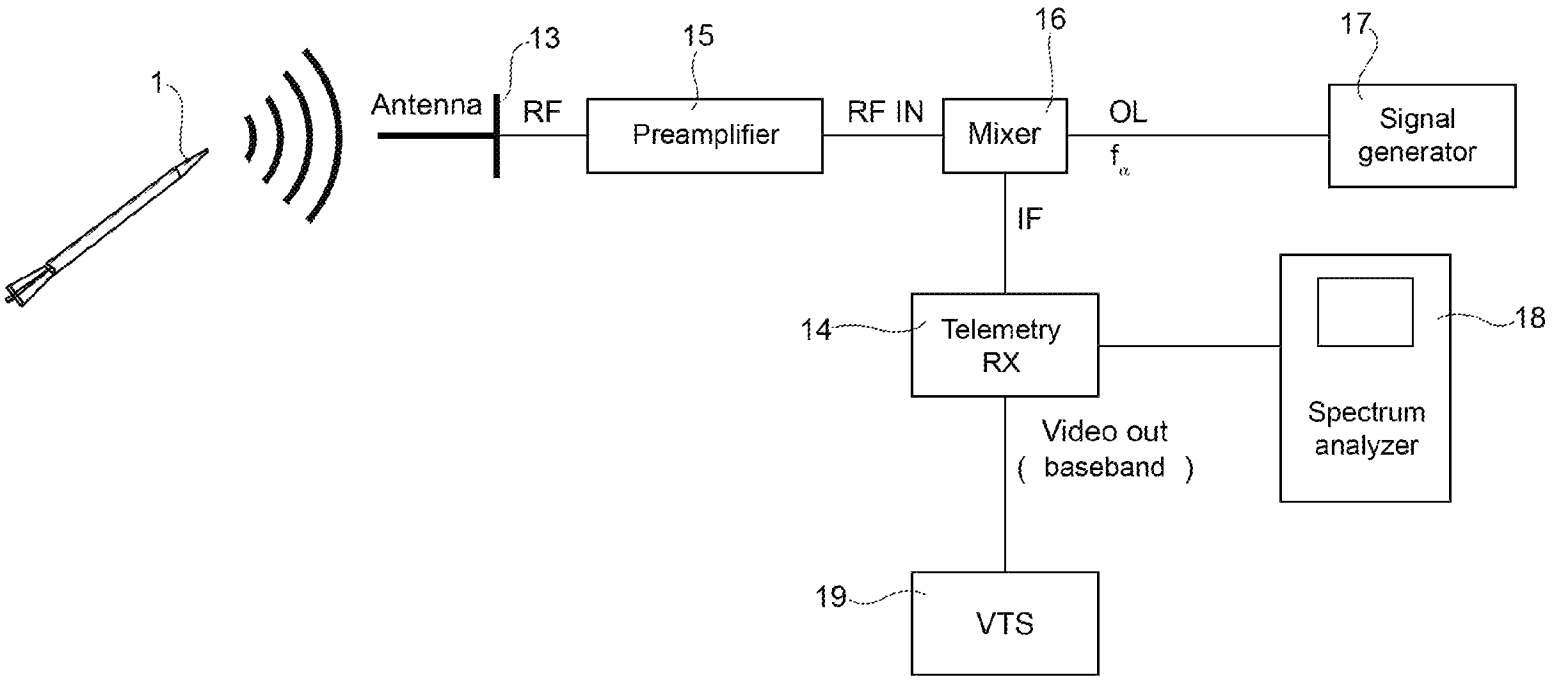
FIG. 2 shows a block diagram of a receiver station to receive telemetry data transmitted by a radar device fuze.

A telemetry station, shown in FIG. 2, is used to receive, demodulate and interpret the telemetry data transmitted by the fuze 1.

The telemetry station basically comprises an antenna 13, a telemetry receiver 14 (basically comprising a tuning section and a frequency demodulator), a signal preamplifier 15 connected to the antenna 13, and an intermediate frequency (IF) conversion section 16 connected between the preamplifier 15 and the telemetry receiver 14 to downconvert or upconvert the telemetry signal transmitted by the radar sensor 9 and received by the antenna 13 to a telemetry frequency band in which the telemetry receiver 14 operates.

The intermediate frequency conversion section 16 basically comprises a mixer where the telemetry signal received by the antenna 13 is caused to beat against a local signal generated by a local oscillator 17, thus outputting a signal having a frequency that is the sum/difference of that of the telemetry signal and that of the local signal.

The converted telemetry signal is then supplied to a spectrum analyzer 18 and to a visual telemetry system (VTS) 19.

Based on the above, the advantages that the present invention allows to achieve may be appreciated.

In particular, the present invention allows an important fuze resource represented by the radar device to be used to transmit telemetry data indicative of the operation of the explosive weapon and/or of the fuze and useful to appropriately manage the explosive weapon's mission.

In fact, the implementation of the telemetry function requires a simple intervention at a software level, without requiring the provision of further components.

The invention claimed is:

1. A fuze (1) for an explosive weapon, comprising:

onboard sensors (8) to monitor operation of the fuze (1) and/or of the explosive weapon, a radar device (9) to transmit radar signals and receive reflected radar signals, and an electronic signal processor (10) connected to the onboard sensors (8) and to the radar sensor (9), the electronic signal processor (10) is programmed to implement a main operating function designed to implement an explosive weapon detonation logic based on received radar signals from the radar device (9) or on signals from the onboard sensors (8);

wherein the electronic signal processor (10) is further programmed to implement a secondary operating function supplementary to the main operating function and comprising a telemetry function designed to determine, based on signals from the onboard sensors (8), and to transmit, via the radar device (9), telemetry data indicative of flight diagnostics of the explosive weapon during flight thereof, wherein the electronic signal processor (10) is further programmed to allow an implementation mode of the secondary operating function to be programmed, and wherein the electronic signal processor (10) is further programmed to allow the implementation mode of the secondary operating function to be selected from available implementation modes comprising an implementation mode in which the secondary operating function is implemented in periods of time when the main operating function is not implemented, and an implementation mode in which the secondary operating function is implemented simultaneously with the main operating function.

2. The fuze (1) of claim 1, wherein the electronic signal processor (10) is further programmed to allow the main operating function to be programmed.

3. The fuze (1) of claim 2, wherein the electronic signal processor (10) is further programmed to allow the main operating function to be selected from available operating functions, each having an associated detonation logic.

4. The fuze (1) of claim 3, wherein the available operating functions comprise an altimetry function, a proximity function, an impact function, and a delayed-impact function.

5. The fuze (1) of claim 1, wherein, when the secondary operating function is programmed to be implemented in periods of time when the main operating function is not implemented, the electronic signal processor (10) is further designed to implement the secondary operating function in a first part of the explosive weapon flight, and the main operating mode in a final part of the explosive weapon flight.

6. The fuze (1) of claim 1, wherein, when the secondary operating function is programmed to be implemented simultaneously with the main operating function, the electronic signal processor (10) is further designed to implement the secondary operating function during the entire flight or part of the flight of the explosive weapon.

7. The fuze (1) of claim 1, wherein the electronic signal processor (10) is further designed to cause the telemetry data to be transmitted, via the radar device (9), in the form of a PCM (Pulse-Code Modulation) digital sequence modulated according to a digital modulation.

8. The fuze (1) of claim 7, wherein the digital modulation is an FSK (Frequency Shift Keying) digital frequency modulation.

* * * * *